US006131655A

United States Patent [19]

Shaw

[11] Patent Number: 6,131,655

[45] Date of Patent: Oct. 17, 2000

[54] APPARATUS AND METHODS FOR DOWNHOLE FLUID SEPARATION AND CONTROL OF WATER PRODUCTION

[75] Inventor: Christopher K. Shaw, Claremore, Okla.

[73] Assignee: Baker Hughes Incorporated, Houston, Tex.

[21] Appl. No.: 09/022,348

[22] Filed: Feb. 11, 1998

Related U.S. Application Data

[60] Provisional application No. 60/038,176, Feb. 13, 1997.

[51] Int. Cl.[7] ..... E21B 43/14

[52] U.S. Cl. ..... 166/105.5; 166/54.1; 166/250.15

[58] Field of Search ..... 166/52, 266, 313, 166/369, 378, 306, 54.1, 67, 105.5

[56] References Cited

U.S. PATENT DOCUMENTS

| | | | |
|---|---|---|---|
| 2,953,204 | 9/1960 | Doscher et al. | 166/9 |
| 3,137,344 | 6/1964 | Wiemer | 166/9 |
| 3,705,626 | 12/1972 | Glenn, Jr. et al. | 166/267 |
| 3,707,157 | 12/1972 | Tipton et al. | 137/14 |
| 3,951,457 | 4/1976 | Redford | 299/5 |
| 3,978,926 | 9/1976 | Allen | 166/267 |
| 4,120,795 | 10/1978 | Lavel, Jr. . | |
| 4,148,735 | 4/1979 | Lavel, Jr. . | |
| 4,241,787 | 12/1980 | Price . | |
| 4,296,810 | 10/1981 | Price . | |
| 4,354,553 | 10/1982 | Hensley | 166/244 |
| 4,475,603 | 10/1984 | Hayatdavoudi . | |
| 4,488,607 | 12/1984 | Hayatdavoudi et al. . | |
| 4,573,540 | 3/1986 | Dellinger et al. | 175/61 |
| 4,688,650 | 8/1987 | Hayatdavoudi et al. . | |
| 4,721,565 | 1/1988 | Carroll | 210/251 |

(List continued on next page.)

FOREIGN PATENT DOCUMENTS

| | | |
|---|---|---|
| 0 532 397 A1 | 3/1993 | European Pat. Off. . |
| 2194 575A | 9/1987 | United Kingdom . |
| WO 94/13930 | 6/1994 | WIPO . |

OTHER PUBLICATIONS

Pete Schrenkel, Robert Cox, Steve Kennedy and Bill Bowers; "Joint Industry Development of the Downhole Oil Water Separation System".

B.E. Bowers, D.D. Lloyd, C. Matthews and P. Schrenkel; "Downhole Application of Liquid–Liquid Hydrocyclones".

B.R. Peachey and C.M. Matthews, "Downhole Oil/Water Separator Development";*The Journal of Canadian Petroleum Technology;* vol. 33, No. 7 (Sep. 1994).

B.R. Peachey and C.M. Matthews, "Downhole Oil/Water Separator Development"; Petroleum Society of CIM, Paper No. CIM 93 (circa 1994).

"Downhole Oil/Water Separation Technology Now Proven", Centre for Engineering Research Inc., Press Release (Apr. 1, 1995).

Kjos. T., et al.: "Subsea and DownHole Separation Systems—The latest advances"; IBC Tech. Serv. Worldwide Deep Water Tech. Conference Feb. 26, 1996; pp. 1–4.

*Primary Examiner*—Frank Tsay

*Attorney, Agent, or Firm*—Thomason, Moser & Patterson, L.L.P.

[57] ABSTRACT

The present invention related to a system which prevent coning while minimizing the problems associated with any reverse coning which may result. The system includes a production string disposed within a wellbore having both oil production perforations and water production perforations, wherein the production tubing is packed off against the wellbore annulus between the oil production perforations and the water production perforations. In addition to a pump for producing oil from the oil production perforations, a water pump is incorporated into the production tubing proximate the water production perforations in order to pump water to a reinjection point or other location. The system also permits recovery of amounts of oil and even solids existing within the water layer, preferably by the use of a separator. The separated oil is then directed upward through the production string for recovery. The invention permits increased pump rates by the pumps located both above and below the packer.

11 Claims, 12 Drawing Sheets

U.S. PATENT DOCUMENTS

| | | | |
|---|---|---|---|
| 4,738,779 | 4/1988 | Carroll et al. . | |
| 4,766,957 | 8/1988 | McIntyre . | |
| 4,787,452 | 11/1988 | Jennings, Jr. | 166/272 |
| 4,793,408 | 12/1988 | Miffre . | |
| 4,805,697 | 2/1989 | Fouillout et al. . | |
| 4,824,562 | 4/1989 | Carson . | |
| 4,836,935 | 6/1989 | Lilienthal | 210/788 |
| 4,900,433 | 2/1990 | Dean et al. . | |
| 5,296,153 | 3/1994 | Peachey . | |
| 5,309,998 | 5/1994 | Rivas et al. | 166/265 |
| 5,320,500 | 6/1994 | Cholet | 417/375 |
| 5,335,732 | 8/1994 | McIntyre . | |
| 5,377,756 | 1/1995 | Northrop et al. | 166/267 |
| 5,456,837 | 10/1995 | Peachey . | |
| 5,497,832 | 3/1996 | Stuebinger et al. . | |
| 5,503,226 | 4/1996 | Wadleigh . | |
| 5,570,744 | 11/1996 | Weingarten et al. . | |
| 5,603,825 | 2/1997 | Costinel . | |
| 5,730,871 | 3/1998 | Kennedy et al. . | |
| 5,862,863 | 1/1999 | Swisher | 166/313 |

APPARATUS AND METHODS FOR DOWNHOLE FLUID SEPARATION AND CONTROL OF WATER PRODUCTION

This application claims the benefit of U.S. Provisional Application Ser. No. 60/038,176, filed Feb. 13, 1997.

BACKGROUND OF THE INVENTION

1. Field of the Invention

The present invention relates generally to apparatus and methods for accomplishing separation of liquids of different densities in fluid streams from underground wells. In one aspect, the invention also relates to control of the oil-water interface in production reservoirs as well as the prevention of the problems associated with coning and reverse coning.

2. Background of the Related Art

In most hydrocarbon production areas, a relatively permeous layer or zone containing hydrocarbons is trapped horizontally between layers of relatively impermeable rock. There exists a natural separation of gas, oil and water within the zone. The gas, being the lightest of the three, tends to migrate toward the top of the production zone. The water tends to migrate toward the bottom of the production zone leaving an oil layer sandwiched in the middle. The interface between the gas and oil is often referred to as the gas-oil contact, while the interface between oil and water is often referred to as the oil-water contact. During an oil production operation, the object is to remove as much oil from the formation without removing the water below it. It may or may not be desired to remove the gas. In order to prevent removing water with the oil, however, production perforations into a hydrocarbon production zone are normally made above the oil-water contact. Oil is drawn into the wellbore through these production perforations and then transmitted to the surface through production tubing.

Because water has a higher relative permeability than oil, a phenomenon known as coning tends to occur wherein the water is drawn upward through the reservoir toward the production perforations as the oil is drawn off. If the water succeeds in reaching the production perforations, it may block or substantially reduce further entry of oil into the wellbore, thereby leaving pockets of oil behind which cannot be recovered. Additionally, the presence of water in the wellbore and production tubing is undesirable as it increases the hydrostatic head within the wellbore.

Past efforts at preventing coning have focused on locating the production perforations to penetrate the oil layer as high as possible above the oil-water contact in an effort to reduce or delay water coning. Although this approach will be effective until the oil layer is reduced, it has the disadvantage that the perforated interval, or interval between the top of the production perforations and the bottom of the production perforations, cannot cover the full span of the oil leg that remains in the reservoir.

An alternative approach to preventing coning has recently been proposed in which a well is completed so that there are separate perforations for production fluid and produced water from the reservoir. The proposal was outlined by B. R. Peachey and C. M. Matthews in "Downhole Oil/Water Separator Development," in Vol. 33, No. 7, *The Journal of Canadian Petroleum Technology* (September 1994) at 17–21. In the proposal, the production tubing is packed off against the annulus of the wellbore by a packer which is set approximately at the level of the oil-water contact. The production perforations would be located above the packer so as to penetrate the oil layer and permit oil to enter the wellbore above the packer. Produced water perforations would then be located below the packer so as to penetrate the water layer so that water will enter the wellbore below the packer. The proposal envisions incorporating a dual stream pump arrangement into the production tubing string which includes a low volume, high head oil pump and a high volume, low head water pump. The water would be pumped either to a lower zone in the same reservoir or to a separate zone suitable for water disposal that is accessible from the same well. The oil pump would pump separated oil through the production tubing toward the surface for recovery.

The use of offsetting produced water perforations creates a pressure sink which aids in reducing coning by drawing off water at a location below production perforations and will even generate some "reverse coning" of the fluids in the near wellbore area. Reverse coning occurs when oil from the oil layer migrates downward through the formation toward the water perforations. Unfortunately, reverse coning may ultimately result in loss of production fluid through the produced water perforations located below the packer. This is undesirable. The present invention provides a solution to the problems found in the prior art.

In another aspect of the invention, intelligent and semi-intelligent production systems are described which are capable of monitoring the approximate position of the oil-water contact in the surrounding formation and adjusting pump and flow rates to adjust the position.

SUMMARY OF THE INVENTION

The present invention is directed toward a system which permits water to be drawn down to prevent coning while minimizing the problems associated with any reverse coning which may result. The invention also permits recovery of amounts of oil and even solids existing within the water layer. Several exemplary, inventive production assemblies are described in which a production string is disposed within a wellbore having both oil production perforations and water production perforations. The production tubing is packed off against the wellbore annulus between the oil production perforations and the water production perforations. A water pump is incorporated into the production tubing proximate the water production perforations. The water is pumped away by the pump to a reinjection point or other location.

According to one aspect of the invention, a separator is operably associated with the water pump to remove amounts of oil from production water. The separated oil is then directed upward through the production string for recovery. The invention permits increased pump rates by the pumps located both above and below the packer.

The invention also provides for the provision of cleaner water into injection zones by removal of materials such as solids and oil whose presence in the injection zone would be undesirable.

Embodiments of the invention are also described wherein the reinjection perforations are located above the production perforations.

DETAILED DESCRIPTION OF THE PREFERRED EMBODIMENTS

Figure 1:
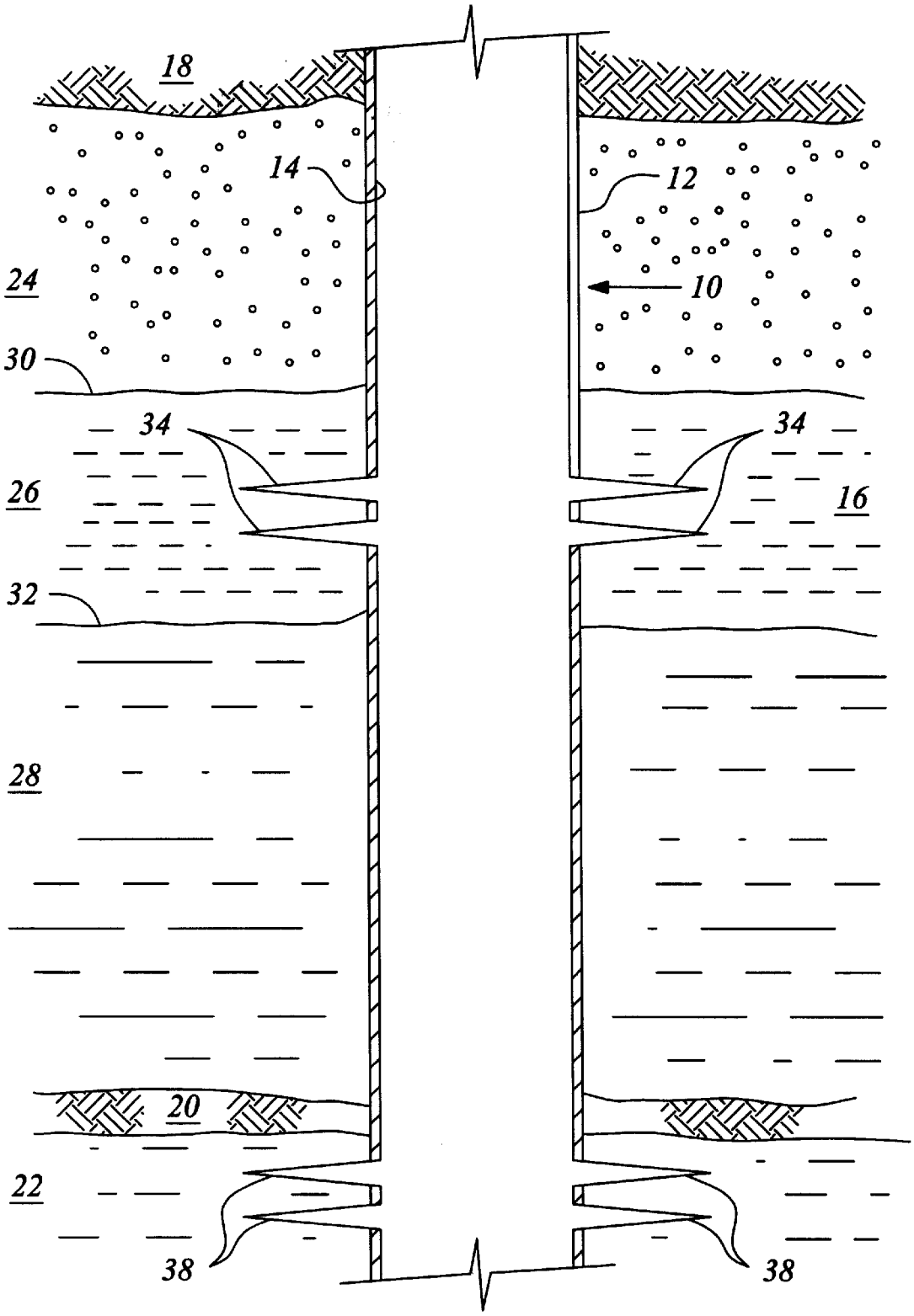
FIG. 1 is a cross-sectional schematic drawing of an exemplary well depicting natural segregation in a production zone.

In the following description, common features among the described embodiments will be designated by like reference numerals. Unless otherwise specifically described in the specification, components described are assembled or affixed using conventional connection techniques including threaded connection, collars and such which are well known to those of skill in the art. The use of elastomeric O-rings and other standard techniques to create closure against fluid transmission is also not described herein in any detail as such conventional techniques are well known in the art and those of skill in the art will readily recognize that they may be used where appropriate. Similarly, the construction and operation of hanger systems and wellheads is not described in detail as such are generally known in the art. Examples of patents which describe such arrangements are U.S. Pat. No. 3,918,747 issued to Putch entitled "Well Suspension System," U.S. Pat. No. 4,139,059 issued to Carmichael entitled "Well Casing Hanger Assembly," and U.S. Pat. No. 3,662,822 issued to Wakefield, Jr. entitled "Method for Producing a Benthonic Well." These patents are incorporated herein by reference.

Because the invention has application to wells which may be deviated or even horizontal, terms used in the description such as "up," "above," "upward" and so forth are intended to refer to positions located closer to the wellbore opening as measured along the wellbore. Conversely, terms such as "down," "below," "downward," and such are intended to refer to positions further away from the wellbore opening as measured along the wellbore.

Prior to description of particular production string assemblies contained within a well, it will aid in understanding various aspects of the invention to discuss the effects of "coning" and "reverse coning" in production zones. These effects are depicted schematically in FIGS. 1, 1A and 1B and will now be briefly described. Portions of a hydrocarbon production well 10 is depicted in these figures. The well 10 includes a wellbore casing 12 which defines an annulus 14. The well 10 extends downward from a wellbore opening or entrance at the surface (not shown), and through a fluid-permeous hydrocarbon production zone 16 from which it is desired to acquire production fluid. During production operations, the annulus 14 will contain a production string through which wellbore fluids are transmitted. For clarity of explanation, however, the production string is not shown in FIGS. 1, 1A or 1B.

Figure 1A:
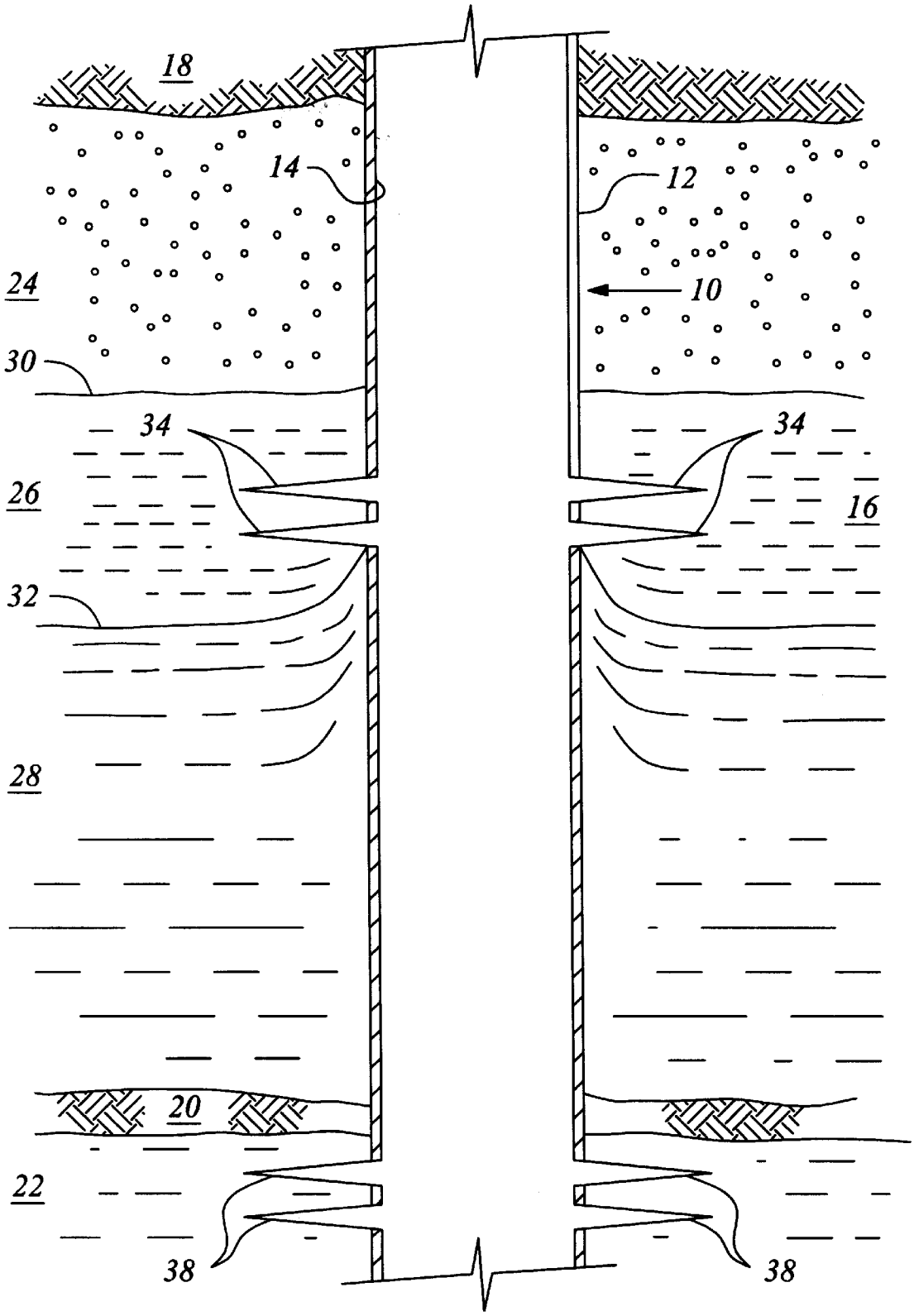
FIG. 1A is a cross-sectional schematic drawing of an exemplary well illustrating the influence of coning.
Figure 1B:
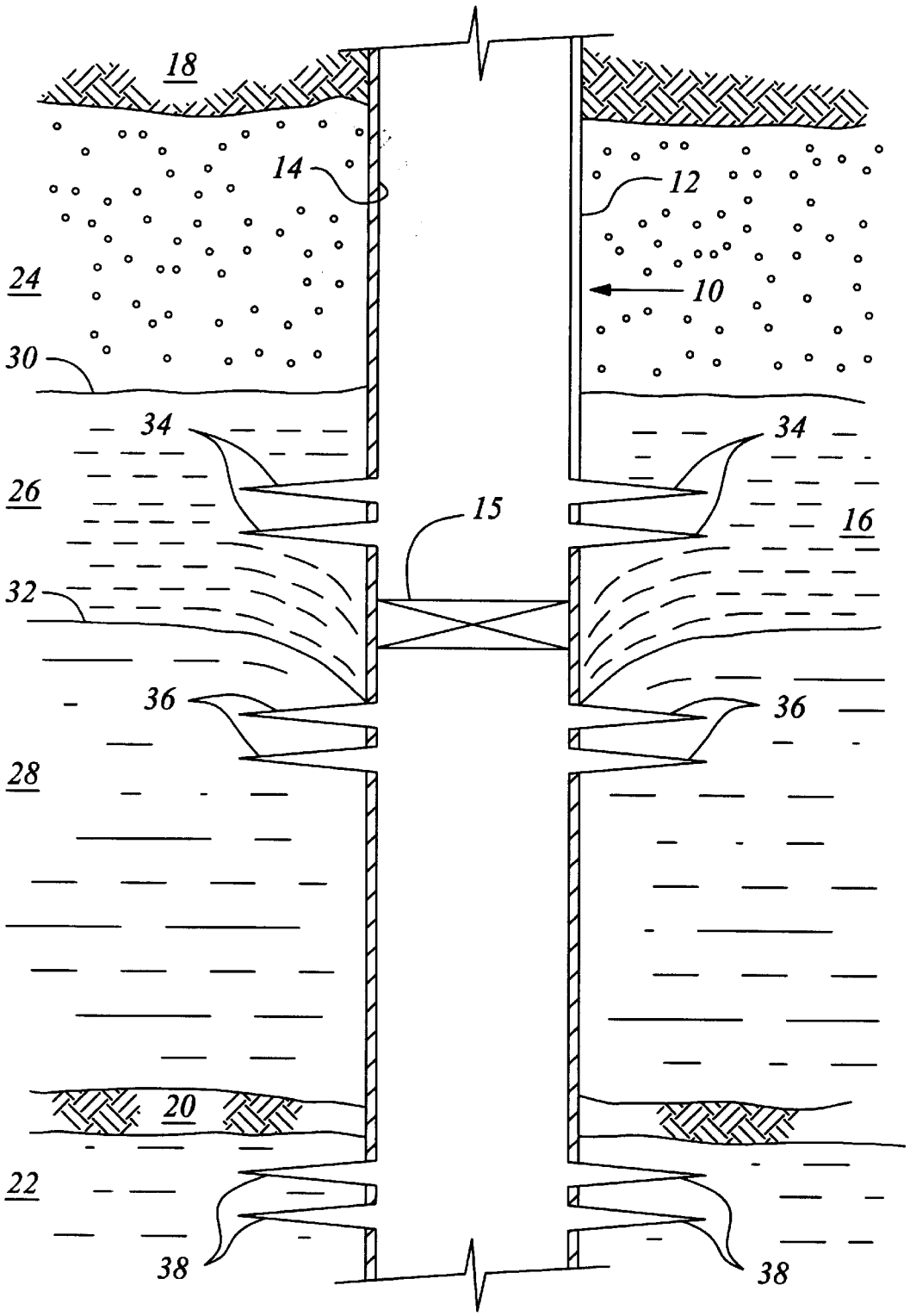
FIG. 1B is a cross-sectional schematic drawing of an exemplary well illustrating the influence of reverse coning.

In FIG. 1B, a fluid barrier 15 is shown established at the approximate level of the oil-water contact 32. It is pointed out that the fluid barrier 15 in FIG. 1B is merely a schematic representation for the concept that fluid transmission across this portion of the annulus 14 is prevented. In practice, a fluid barrier may be established using packers, plugs and similar devices. The fluid barrier 15 functions to prevent commingling in the annulus 14 of production fluid obtained from the production perforations 34 with produced water entering the annulus 14 through the produced water perforations 36.

The production zone 16 is bounded at its upper end by a first relatively impermeable layer of rock 18 and at its lower end by a second relatively impermeable layer of rock 20. Below the second relatively impermeable rock layer 20 lies an additional fluid permeous zone 22 into which it is desired to inject water. The production zone 16 is itself divided into an upper gas layer 24, which contains largely production gasses; a central oil layer 26, which contains largely production fluid suitable for production from the well 10; and a water layer 28, which contains chiefly water. The gas layer 24 and oil layer 26 are divided by an oil-gas contact, indicated at 30, while the oil layer 26 and water layer 28 are divided from each other by an oil-water contact 32.

The well casing 12 has oil production perforations 34 disposed therethrough so that production fluid from the oil layer 26 may enter the annulus 14. The oil production perforations 34 are located above the oil-water contact 32.

Production water perforations 36 are also disposed through the casing 12 at a location below the production perforations 34 and below the oil-water contact 32. The production water perforations 36 penetrate the water layer 28 so that water from the water layer 28 may enter the annulus 14 through the water perforations 36 below the fluid barrier 15.

Additionally, injection perforations 38 are also disposed through the casing 12 which permit fluid communication therethrough from the annulus 16 into the lower disposal zone 22. In this instance, the well 10 is referred to as a "downhole" arrangement in that the injection perforations 38 are located "downhole" from the production perforations 34.

FIG. 1 is illustrative of the configuration of the production zone 16 prior to initiation of production operations or in the early stages of such production. The oil-water contact 32 is relatively planar along the representative line 32. As significant amounts of production fluid are drawn from the oil layer 26 through production perforations 34, the oil-water contact 32 begins to cone upward toward the production perforations 34, as depicted in FIG. 1A. FIG. 1A, then, depicts the coning effect. By installing a fluid barrier 15 and produced water perforations 36, production water is then drawn into the annulus 14 through the produced water perforations 36, it will offset the coning and, if sufficient amounts of production water are drawn, a reverse cone may occur, as depicted in FIG. 1B.

Figure 2:
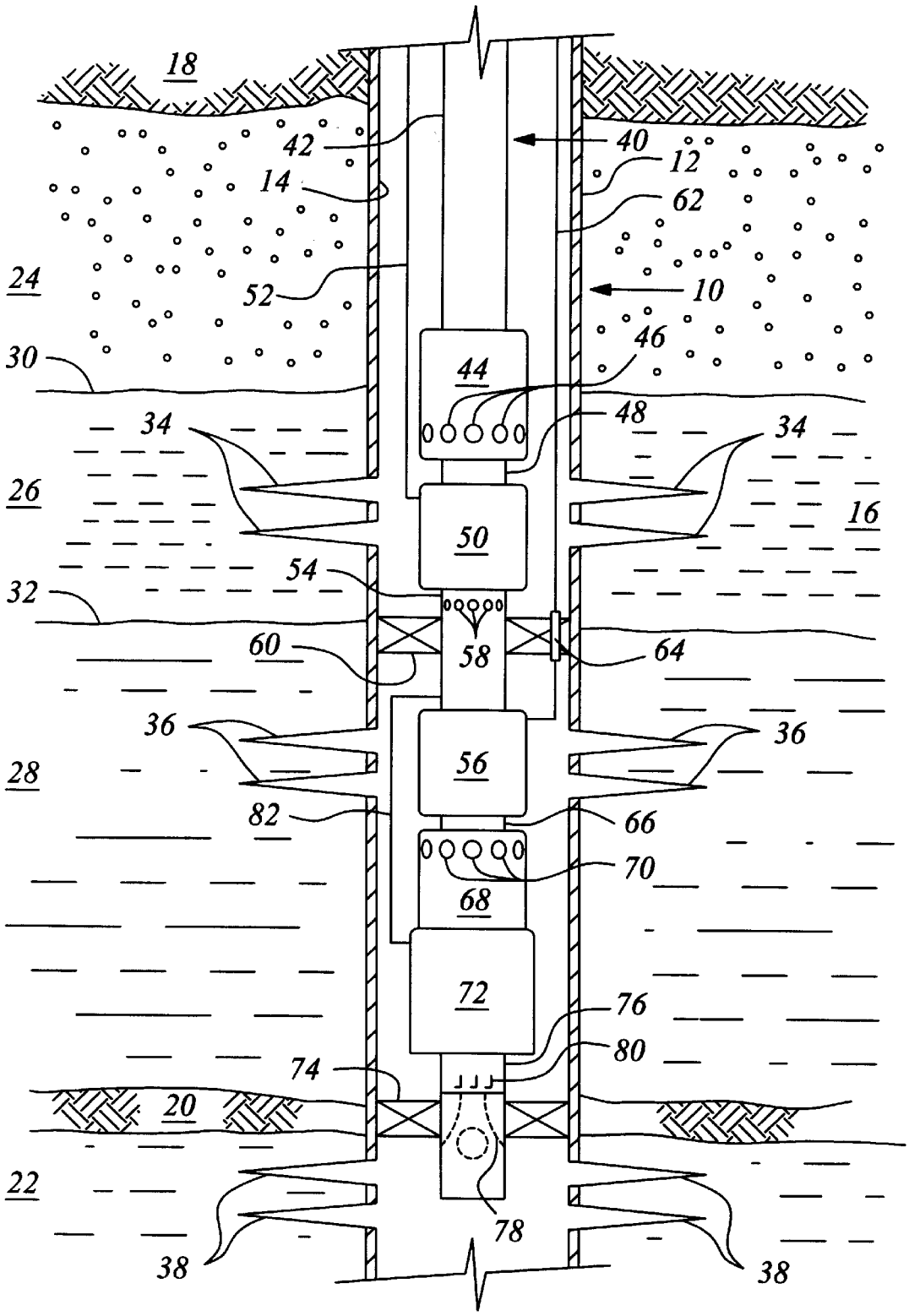
FIG. 2 is a cross-sectional schematic drawing of an exemplary production assembly constructed in accordance with the present invention.

Referring now to FIG. 2, a first exemplary embodiment of the present invention is depicted in which a production string assembly 40 is shown disposed downward within the annulus 14 supported from a wellhead (not shown) at the surface. The production string assembly 40 includes production tubing 42 which is affixed at its upper end to a wellhead (not shown). At the lower end of production tubing 42 is affixed a first fluid pump 44 having a low volume, high head capacity. The first pump 44 is of the type known in the art for use in wellbores to pump fluids. Examples include a multistage centrifugal fluid pump and a progressive cavity pump. The first pump 44 presents lateral fluid intake ports 46 disposed about its circumference so that fluid located within the annulus 14 may be drawn into the first pump 44 therethrough. The pump 44 is intended to function as a relay pump to assist transmission of a concentrated oil stream to the surface of the well 10. The first pump 44 is affixed with a seal 48 of customary design to a first motor 50. The motor 50 is an electrical submersible motor of a type known in the art for operation of downhole pumps. A power cable 52 supplies power to the first motor 50.

It is pointed out that alternative arrangements may be made for the particular pumping assembly described without affecting the results of performance of the production string assembly 40. For example, the pump 44 and motor 50 may be replaced by a surface-driven pump, such as a progressive cavity pump or a rod-driven pump. Further, gas lift devices may be incorporated into the assembly 40 to carry separated oil to the surface of the well. Additionally, it is noted that there may be sufficient natural pressure in the surrounding formation so that the separated oil might be lifted to the surface under its influence. Techniques for accomplishing this are known in the art.

A section of production tubing 54 extends from the lower end of the first motor 50 to a second motor 56 to adjoin the two motors. The second motor 56 is also an electrical submersible motor. The production tubing section 54, although shown to be relatively short in length in the schematic of FIG. 1, may be of any desired length. It is contemplated that the length of tubing section 54 may be between 10–10,000 feet.

The connecting portion of the production tubing 54 contains lateral fluid perforations 58 so that fluids exiting from the production tubing section 54 through the perforations 58 will flow upward to be drawn into the pump 44 through the fluid intake ports 46.

An upper packer 60 seals off the tubing section 54 from the wellbore casing 12. It is noted that the upper packer 60 is set to create its seal at the approximate level of the oil-water contact 32. Thus, the upper packer 60 serves the purpose of establishing a fluid barrier such as the fluid barrier depicted schematically in FIG. 1B.

A second power cable 62 which extends from the surface of the well 10 supplies power to the second motor 56. A packer penetrator 64 is used to pass the power cable 62 through the upper packer 60. A suitable packer penetrator for this application is the Packer Penetrator System available commercially from Quick Connectors, Inc. of 5226 Brittmore, Houston, Tex., amongst others. The lower end of the second motor 56 is affixed using an elastomer seal 66 to a second pump 68 also having lateral fluid intake ports 70. The second pump 68 is operationally interconnected with a separator assembly 72. The separator assembly 72 is a hydrocyclone-based separator assembly useful for separating a mixed fluid into two constituent fluids, such as oil and water. A suitable separator assembly for such applications, as well as the applications described herein, is the VORTOIL® Downhole Oil Water Separator assembly available commercially from Baker-Hughes Process Systems, 6650 Roxburgh, Suite 180, Houston, Tex. 77041. Aspects of the construction and operation of some separator assemblies are also described in U.S. Pat. No. 5,296,153, "Method and Apparatus for Reducing the Amount of Formation Water in Oil Recovered from an Oil Well," and U.S. Pat. No. 5,456,837, "Multiple Cyclone Apparatus and Downhole Cyclone Oil/Water Separation," both issued to *Peachey*; International PCT Published Patent Application WO 94/13930, entitled "Method for Cyclone Separation of Oil and Water and Means for Separating of Oil and Water," as well as other patents and publications.

Below the separator assembly 72, a lower packer 74 seals off outflow tubing 76 which extends from the lower end of the separator assembly 72 toward the disposal zone 22. The outflow tubing 76 is provided with a close-off check valve 78 and a quick disconnect 80. Separated oil conduit 82 extends between the separator assembly 72 to production tubing section 54.

The production arrangement 40 described with respect to FIG. 2 operates generally as follows during a petroleum production operation. Production fluid from the oil layer 26 enters the wellbore casing 12 through the production perforations 34 and is drawn into the first pump 44 through lateral intake ports 46. The first pump 44 then pumps this relatively rich production fluid through the production tubing 42 toward the surface of the well 10.

Water from the water layer 28 of the production zone 16 enters the wellbore casing 12 through the produced water perforations 36. The produced water is then drawn into the second pump 68 through intake ports 70 and then pumped by the pump 68 into the separator assembly 72. The produced water will undergo separation within the separator assembly 72 so that oil present within the produced water will be separated from the water. Separated oil exits the separator assembly 72 via the separated oil conduit 82. The separated oil conduit 82 then transmits the separated oil into the production tubing section 54 below the level of the upper packer 60. The separated oil is then disposed upward within the production tubing section 54 and exits the tubing section 54 through perforations 58 into the annulus 14 above the upper packer 60 where it mingles with the production fluid obtained from the oil layer 26.

Upon separation of the produced water from water layer 28, the separator assembly will also produce a separated water stream. The separated water stream is directed through outflow tubing 78 toward the injection perforations 38 located below the lower packer 74. The separated i water will then enter the zone 22 through the injection perforations 38.

Figure 3:
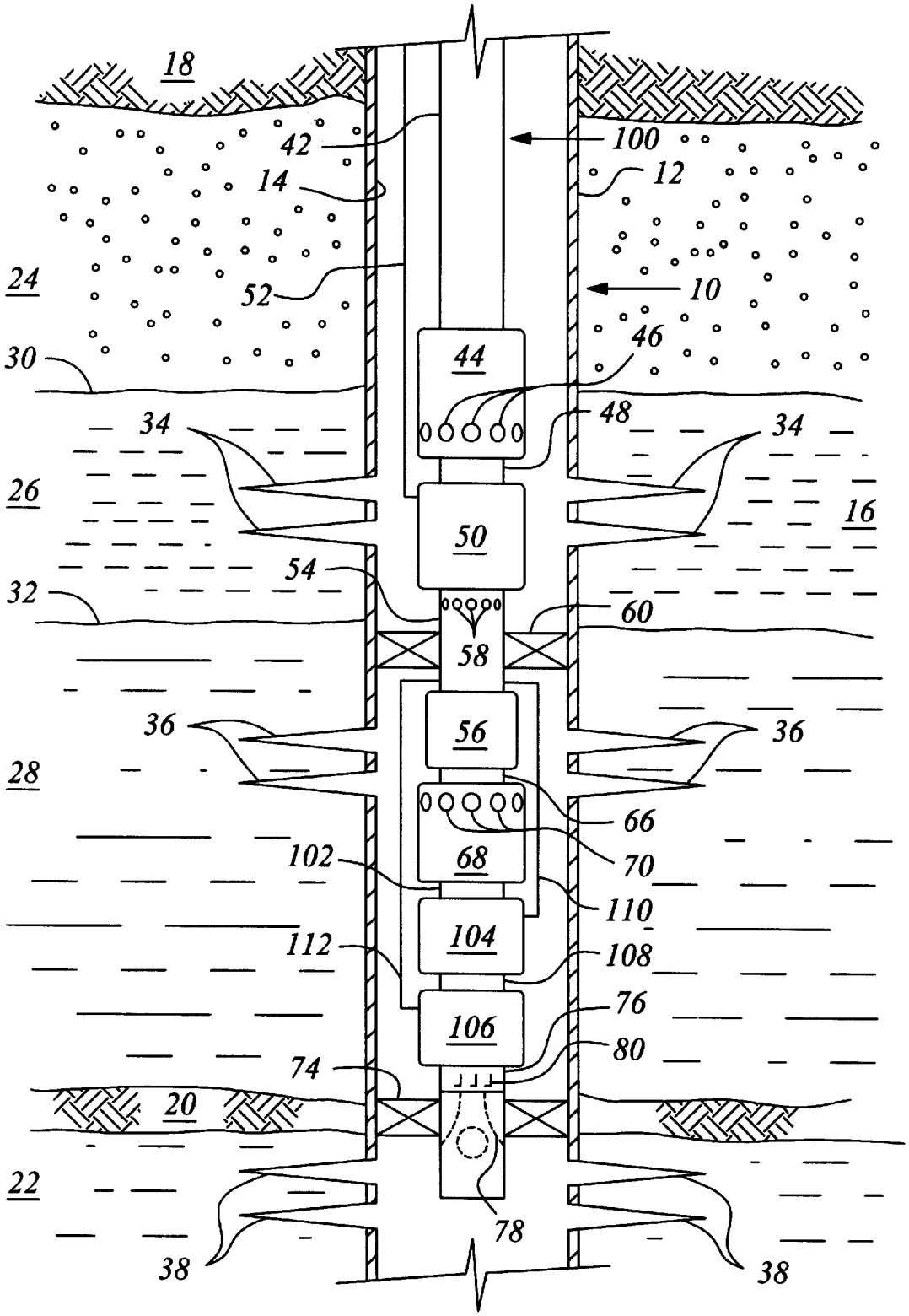
FIG. 3 is a cross-sectional schematic drawing of a first alternative embodiment of a production assembly constructed in accordance with the present invention which incorporates dual separator assemblies.

Referring now to FIG. 3, an alternative embodiment is depicted for a production arrangement constructed in accordance with the present invention. A production assembly 100 is suspended within the annulus 14. Like the production assembly 40 previously described, the production assembly 100 includes production tubing 42 which is affixed at its lower end to a fluid pump 44 which has lateral fluid intake ports 46. The pump 44 is affixed with an elastomer seal 48 to motor 50. Production tubing section 54 affixes the motor 50 to a second motor 56. The second motor 56 is likewise affixed with an elastomer seal 66 to a second pump 68. A tubing section 102 interconnects the lower end of the second pump 68 to an upper separator assembly 104. The upper separator assembly 104 is a solids-separating separator such as a de-sander hydrocyclone separator available commercially from Baker-Hughes Process Systems, 6650 Roxburgh, Suite 180, Houston, Tex. 77041. The upper separator assembly 104 is operationally interconnected to a lower separator assembly 106 by a connection sub 108 which may be a section of tubing adapted to transmit fluid between the upper and lower separator assemblies 104, 106. A separated solids transport conduit 110 extends between the upper separator assembly 104 and the production tubing section 54 so that separated solids which have been separated from the produced water by the upper separator assembly 104 may be transmitted from the upper separator assembly 104 to the production tubing section 54. A separated oil transport conduit 112 extends between the lower separator assembly 106 and the production tubing section 54 so that separated oil which is separated from the produced water by the lower separator assembly 106 may be transmitted from the lower separator assembly 106 to the production tubing section 54.

The production arrangement 100 functions, in most respects, similarly to the production arrangement 40 described with respect to FIG. 2. However, the production arrangement 100 utilizes dual separator assemblies. The first of these separator assemblies, 104, removes solids, such as sand, from the produced water.

Production fluid is obtained from the oil layer 26 through the production perforations 34 and, upon entering the upper pump 44, the production fluid is pumped upward by the upper pump 44 through the production tubing 42 in the same manner as was previously described with respect to production arrangement 40. Also, produced water is obtained from the water layer 28 through the produced water perforations 36 and is drawn into the lower pump 68 through the lateral ports 70 where it is then pumped into the upper separator assembly 104.

Produced water entering the upper separator assembly 104 is separated so that solids, such as sand, present in the produced water are removed and disposed into the solids transport conduit 110 for transmission to the production tubing section 54. The water from which the solids have been removed exits the upper separator assembly 104 through the connection sub 108 to enter the lower separator 106 so that it may undergo a second stage of separation in which oil is removed from that water. Oil separated by the lower separator assembly 106 is disposed into the separated oil conduit 112 for transmission to the production tubing section 54. The resulting water, from which the oil has been removed, is directed through the outflow tubing 76 toward the injection perforations 38.

Figure 4:
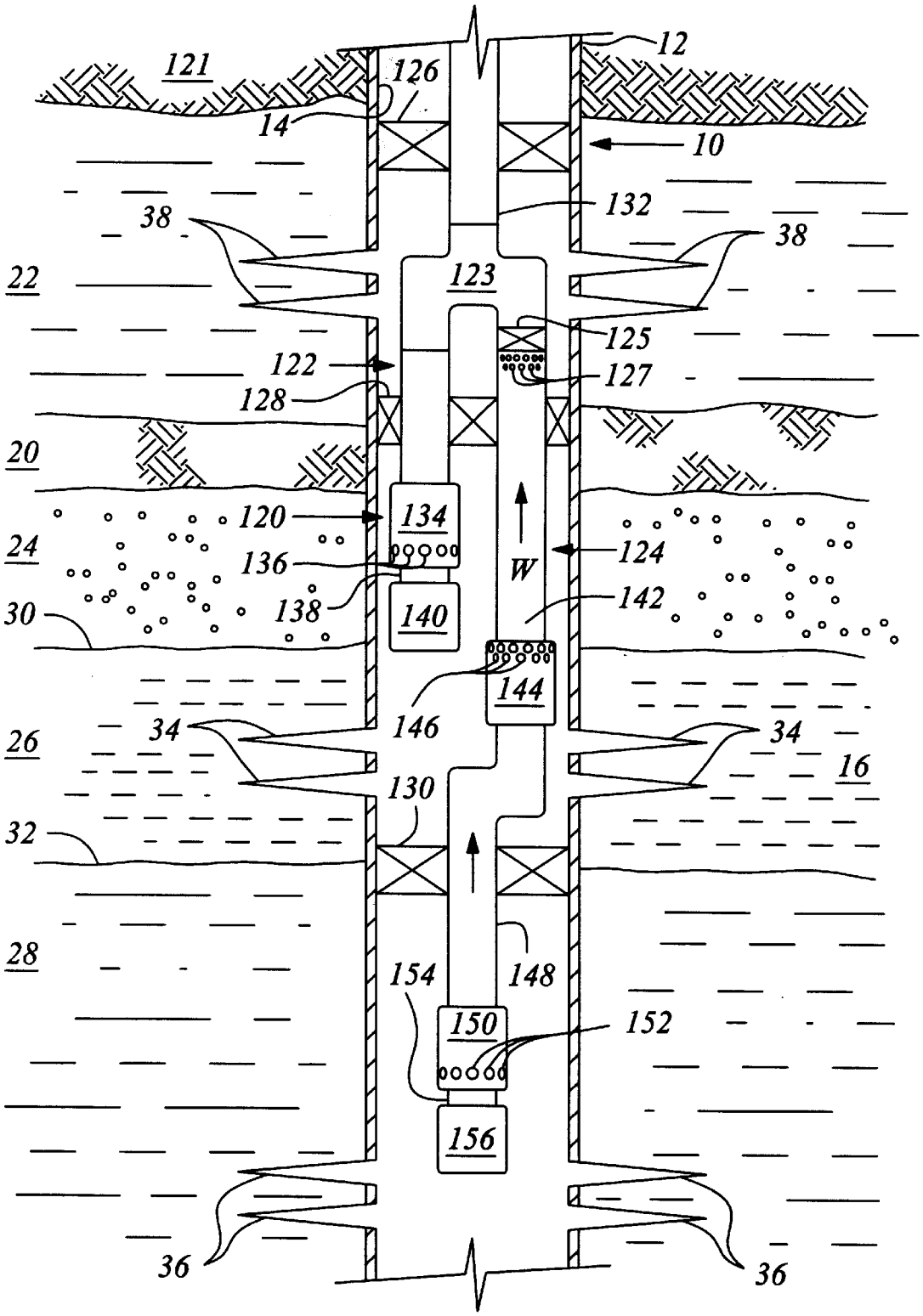
FIG. 4 is a cross-sectional schematic drawing of a second alternative embodiment of a production assembly constructed in accordance with the present invention.

Referring now to FIG. 4, a production arrangement 120 is depicted in which the water injection perforations 38 are located uphole from the production perforations 34 and the water production perforations 36. The disposal zone, or injection zone, 22 is also located uphole from the production zone 16 from which it is desired to obtain production. The disposal zone 22 is separated from production zone 16 by an impermeable zone or layer 20. It is also noted that an additional impermeable zone 121 lies above the disposal zone 22. Thus, the disposal zone 22 is isolated from other potential production zones in the surrounding area.

The production arrangement 120 features a pair of parallel fluid tubing assemblies 122 and 124 affixed to the lower end of a central production string 132 which is disposed within the annulus 14 extending downward from the surface of the well 10. The first fluid tubing assembly 122 extends downwardly to a point below the disposal zone 22. The second fluid tubing assembly 124 is disposed in a parallel relation to the first within the annulus 14 running from an upper point proximate the disposal zone 22 to a lower point which is proximate the water production perforations 36. The first and second tubing assemblies, 122, 124 adjoin each other and the production string 132 at a junction 123. The first tubing assembly 122 is adapted to draw production fluid from the production perforations 34 and transmit it to the surface of the well 10. The second tubing assembly 124 is adapted primarily to receive produced water from the produced water perforations 36 and transmit is to the injection perforations 38 so that it may enter the injection zone 22. The second tubing assembly 124 is also adapted to separate residual oil from the produced water and direct the separated oil into the stream of production fluid being received by the first tubing assembly 122. The separated water, which results from the removal of oil from the produced water is cleaner and, thus, more suitable for injection into a disposal zone.

An upper portion of the inner diameter of the second tubing assembly 124 is plugged at 125. Directly below the plug 125 is a series of fluid communication perforations 127 through the casing of the second tubing assembly 124. An upper packer 126 is set between the first production tubing assembly 122 and the annulus 14 at a point proximate the interface between the upper impermeable zone 121 and the disposal zone 22. The upper packer 126 forms a fluid seal. A dual-penetration packer 128 establishes a seal between the annulus 14 and both the first and second production tubing assemblies 122 and 124. The dual-penetration packer 128 is set proximate the interface between the disposal zone 22 and the impermeable zone 20, but below the level of the fluid communication perforations 127. Finally, a lower packer 130 is set as the approximate level of the oil-water contact 32 to establish a seal between the annulus 14 and the second production tubing assembly 124.

The first fluid tubing assembly 122 is affixed at its lower end to a fluid pump 134 and includes lateral fluid intake ports 136. The pump 134 is affixed by an elastomer seal 138 to motor 140.

The second fluid tubing assembly 124 is made up of an upper section of production flow tubing 142. The tubing section 142 extends through dual-penetration packer 128 to the junction 123 at its upper end and, at its lower end, is affixed to a separator assembly 144. The separator assembly 144 includes a number of circumferentially disposed lateral fluid outlet ports 146. A lower section of production flow tubing 148 interconnects the lower end of the separator 144 to a fluid pump 150 having lateral fluid intake ports 152 circumferentially disposed thereabout. The fluid pump 150 is affixed by an elastomer seal 154 to a motor 156.

In operation, the production arrangement 120 shown in FIG. 4 permits water to be drawn from the water layer of a lower production zone and transported past the layers of oil and gas above it and disposed into an upper disposal zone. The first tubing assembly 122 is operated by energizing the motor 140. The motor 140 then causes the pump 134 to draw production fluid in through fluid intake ports 136. Because the pump 134 is isolated between the packers 128 and 130, it will draw in production fluid which has entered the wellbore 14 through production perforations 34.

The second tubing assembly 124 is operated by energizing motor 156 to draw produced water, which has entered the lower portion of the bore 14 through produced water perforations 36, into the pump 150 via intake ports 152. The pump 150 then pumps the produced water upward through tubing section 148 to separator 144. The produced water is then separated into its constituents of separated oil and separated water. The separated water is directed upward through tubing section 142 past packer 128 and is then disposed through the perforations 127 into the wellbore 14 above the packer 128 so that it may enter the injection perforations 38. Because oil has been separated from the water, the water entering the disposal zone 22 through the injection perforations 38 will be cleaner than production fluid injected without separation, resulting in less disposal of undesirable materials into the disposal zone 22. Meanwhile, the separated oil exits the separator 144 through the fluid outlet ports 146 to enter the wellbore 14 in the area between the packers 128 and 130 where it can mingle with the production fluid entering from production perforations 34. Because of this mingling, the production fluid obtained by the first tubing assembly 122 and transmitted to the surface of the well 10 is typically richer than it would be if only production fluid from the perforations 34 were obtained.

Figure 5:
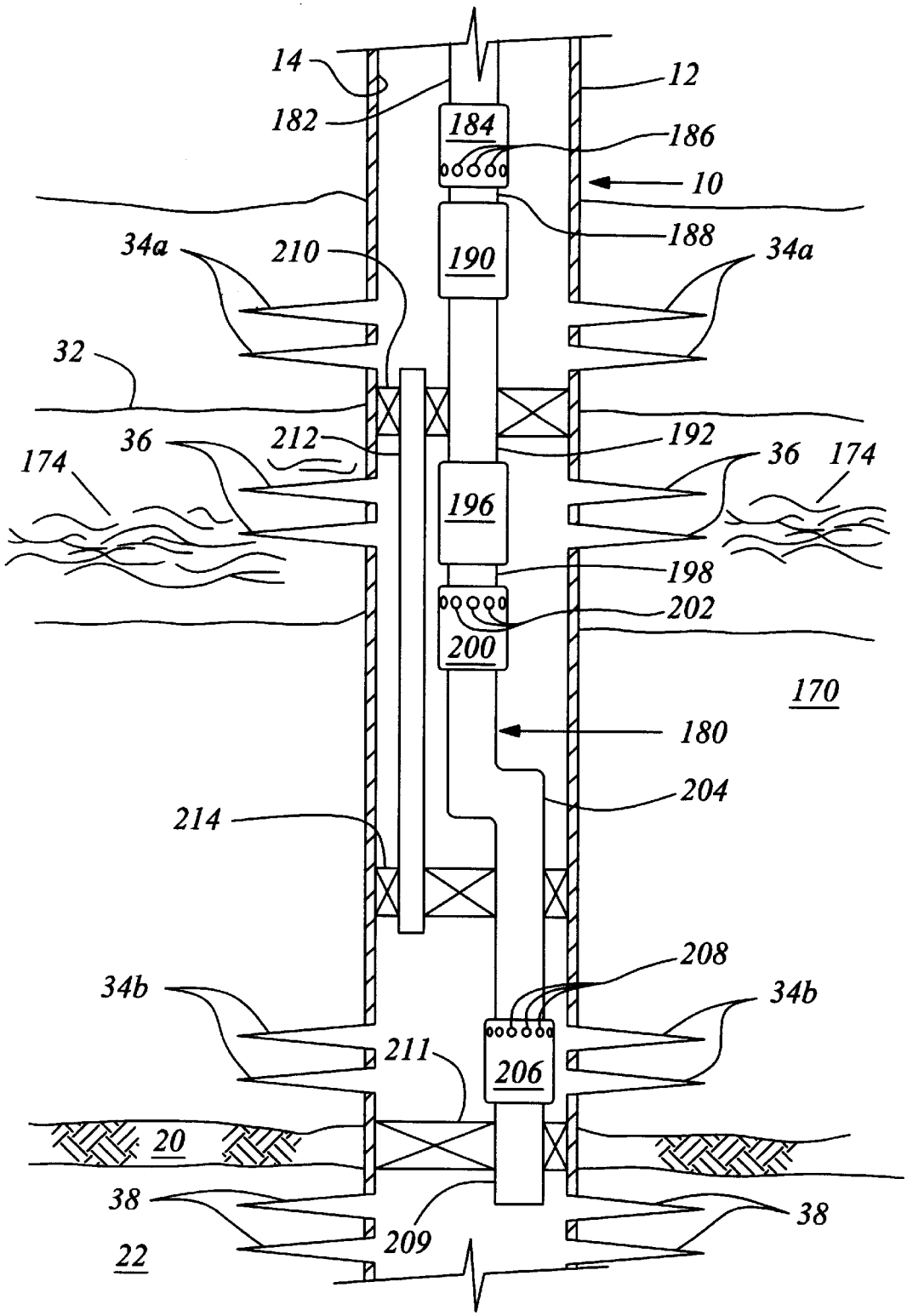
FIG. 5 is a cross-sectional schematic drawing of a third alternative embodiment of a production assembly constructed in accordance with the present invention in which production fluid is obtained from a production zone having stacked layers of oil producing strata.

Referring now to FIG. 5, yet another alternative embodiment of the present invention is depicted in which a production zone 170 is "stacked" such that numerous layers of oil producing strata are present. These stacked strata tend to be less permeable and permit less movement of oil and water than would be true of a zone such as zone 16 described earlier. Also, the individual strata are not as thick from top to bottom as the zone 16 described with respect to previous embodiments. Because of these two factors, fluids present within the strata are, therefore, not significantly susceptible to a substantial natural separation of gas, oil and water as would occur in a thicker zone such as zone 16. Because of the numerous strata present in production zone 170, there are a number of oil production perforations 34. In FIG. 5, two such sets of these perforations are depicted and indicated as production 34*a* and 34*b*. Water perforations 36 also are shown disposed through the casing 12 and into the zone 170.

In stacked production zones such as zone 170, production difficulties arise when horizontal fractures, such as those shown at 174, occur in the various strata. The presence of the fractures permits significant amounts of water, which may be some distance from the well 10, to be transmitted toward the well casing and eventually permeate upward and downward through the various oil producing strata. As a result, the amount of oil recoverable through the production perforations 34*a* and 34*b* will be decreased significantly.

A production arrangement 180 is shown in FIG. 5 to be disposed within the annulus 14 of the well 10. Production tubing string 182 extends downward from the surface of the well 10 and is affixed at its lower end to a fluid pump 184 having lateral fluid intake ports 186. The lower end of the pump 184 is affixed by an elastomer seal 188 to an upper motor 190. Fluid tubing 192 interconnects the upper motor 190 to a lower motor 196. The lower end of the lower motor 196 is affixed by an elastomer seal 198 to a lower fluid pump 200 having intake ports 202. A section of production tubing 204 interconnects the lower fluid pump 200 to a separator assembly 206 having fluid outlet ports 208 circumferentially arranged thereabout. Fluid outflow tubing 209 extends downwardly from the separator assembly 206 toward the disposal zone 22. A packer 211 is set at or around the level of the impermeable zone 20 to establish a fluid seal between the outflow tubing 209 and the annulus 14.

An upper dual-penetration packer 210 is set at the approximate level of the oil-water contact 32 to establish a fluid barrier between the annulus 14 and fluid tubing 192 as well as a fluid conduit 212 which is also disposed within the annulus 14. A lower dual-penetration packer 214 is set above the lower production perforations 34*b* but below the water production perforations 36.

Operation of the production arrangement 180 is substantially as follows. Production fluid enters the annulus 14 through the upper production perforations 34*a* where it is drawn into the upper pump 184 through intake ports 186. The pump 184 then pumps the production fluid upward through the production tubing 182 toward the surface of well 10 for recovery. Production fluid also enters the annulus 14 through the lower production perforations 34*b* where it is drawn upward through fluid conduit 212 and also into the intake ports 186 for pumping to the surface.

Water enters the annulus 14 through the water perforations 36 and is drawn into the fluid pump 200 through intake ports 202. The water which enters the annulus 14 typically contains amounts of oil. The water is pumped by the pump 200 downward through tubing 204 into the separator assembly 206. The separator assembly 206 then separates the amounts of oil from the water and disposes the separated oil through the lateral outlet ports 208 where it will be commingled with the production fluid entering the annulus 14 through the lower production perforations 34*b* and will be transmitted to the surface of the well 10 for recovery.

According to methods of the present invention, the approximate location of the fractures 174 within the zone 170 is determined and a perforating point is then chosen within the annulus 14 corresponding to this approximate location. Water production perforations 36 are then created through the casing 12 and into the zone 170 at the approximate location of the fractures. The water perforations 36 are next isolated from the production perforations 34 by the setting of packers both above and below them or by similar methods. Water permeating the production zone 170 may then be effectively removed and prevented from inhibiting oil production by the removal of the water through the water production perforations 36. Preferably, the water obtained through the water perforations 36 is transmitted to a disposal zone such as disposal zone 22 for injection.

Figure 6:
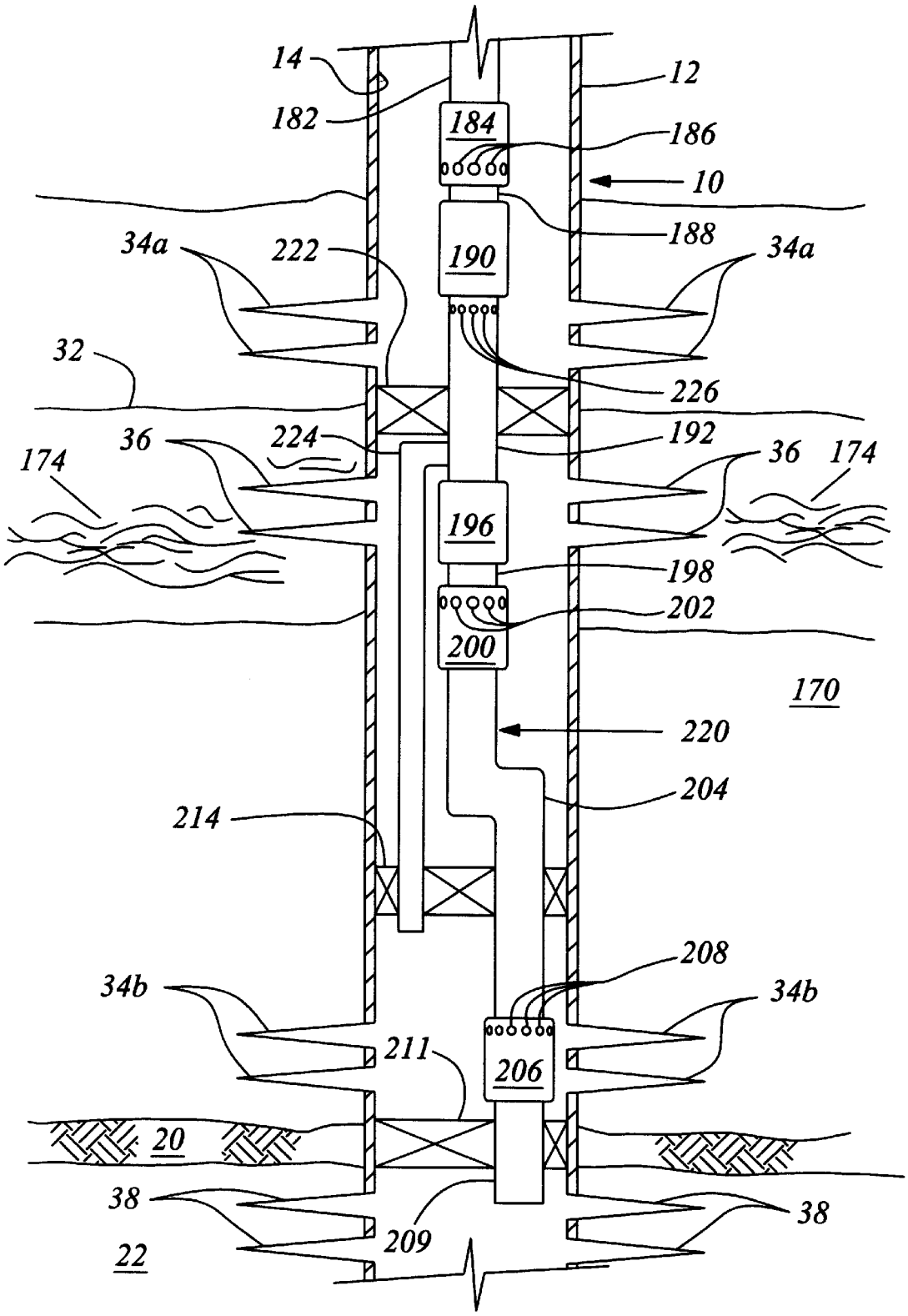
FIG. 6 is a cross-sectional schematic drawing of a fourth alternative embodiment of a production assembly constructed in accordance with the present invention in which production fluid is obtained from a production zone having stacked layers of oil producing strata.

Referring now to FIG. 6, a further embodiment of the invention is depicted which is also useful for obtaining production from zones having stacked layers of oil producing strata and for controlling the entrance of water into the well annulus 14. A production arrangement 220 is depicted which is constructed identically to the production arrangement 180 of FIG. 5 with the following differences. The upper dual-penetration packer 210 of arrangement 180 is replaced with a single penetration packer 222. To accommodate the single penetration packer 222, the fluid conduit 212 is replaced with an elbowed fluid conduit 224 which, at its upper end, flows into tubing section 192 below the packer 222. Finally, tubing section 192 includes lateral fluid outlet ports 226 above the level of the packer 222.

In operation, the production arrangement 220 functions identically to the production arrangement 180 described with respect to FIG. 5 with the following differences. Production fluid entering the annulus through the lower production perforations 34*b* flows upward through the fluid conduit 224 and into the tubing section 192. The production fluid then exits the tubing 192 through outlet ports 226 to be released back into the annulus 14, where it will be commingled with production fluid entering through the upper production perforations 34*a*.

Figure 7:
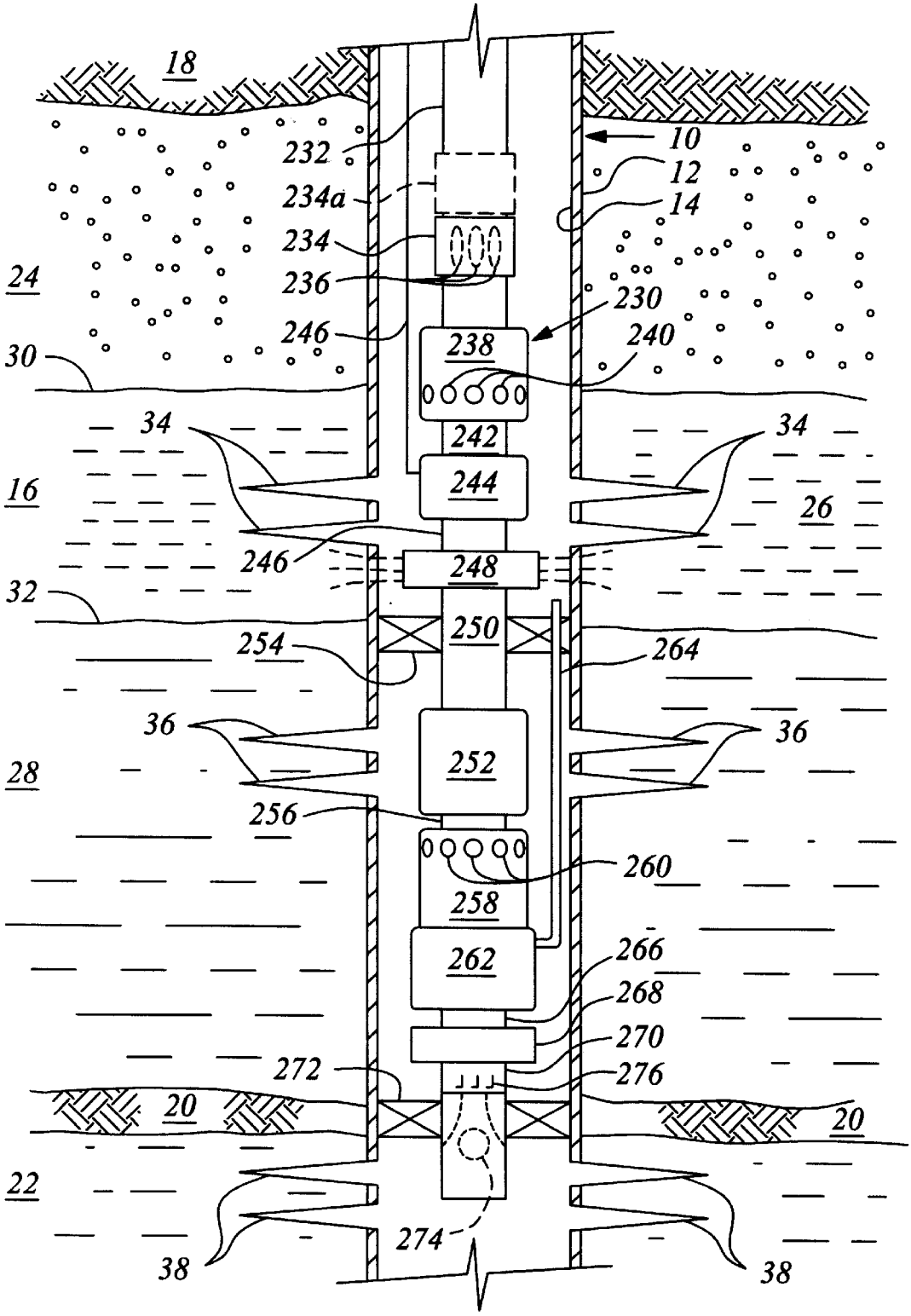
FIG. 7 is a cross-sectional schematic drawing of an exemplary production assembly which is capable of monitoring the approximate position of the oil-water contact to permit adjustment of pumping rates to control that position.

Referring now to FIG. 7, an exemplary production assembly 230 is depicted which is "intelligent" in the sense that it can discern downhole conditions and either allow adjustment, or itself adjust, operation of the production assembly accordingly to assure continued effective production. Production tubing 232 extends downwardly within wellbore 14 from the surface of the well 10. A sliding sleeve arrangement is incorporated along the length of the production tubing in which a sleeve 234 is mounted so as to selectively cover intake ports 236. The sleeve 234 is capable of moving between a first position wherein it covers the ports 236 so that they are closed against fluid communication therethrough and a second position, indicated in phantom at 234A, wherein the ports 236 are open to fluid communication therethrough. One suitable sleeve for this application is the Model CM™ Series Non-Elastomeric Sliding Sleeve available from Baker Oil Tools of Houston, Tex.

At the lower end of the production tubing 232 is a first pump 238 having intake ports 240. The pump 238 is affixed by means of seal 242 to a first motor 244 which operates to drive the first pump 238 and is supplied power from the surface through power line 246.

A production tubing section 250 interconnects the lower end of the first motor 244 to second motor 252, penetrating packer 254 which is set at the original oil/water interface in the formation. If the location of the oil/water interface in the formation 16 or 26 is repetitively monitored in some manner, then any tendency for this interface to move upward or downward can be controlled by varying the pumping rates of pump 238 or pump 258. In order to monitor the location of the oil/water interface in the formation 16 or 26, it is sufficient to monitor the resistivity (or change of resistivity) of the earth formation behind the casing 10. One technique which has proven very useful for this purpose is the measurement of the thermal neutron die away, or decay rate. When neutrons of thermal energy (i.e., less than oil electron volts) are introduced into the earth formations, they are captured by the nuclei of earth formation and fluid components in the formation pore spaces and emit gamma rays of capture. The element chlorine which is abundantly present in most formation water, but not in oil, has a thermal neutron capture cross section much large than that of other common formation elements such as silicon, calcium, hydrogen carbon, and oxygen. This thermal neutron capture cross section is immensely proportional to the time required for thermal neutrons to "die away" or be captured by the elements present. Thus, a fast rate of thermal neutron decay is indicative of the presence of chlorine (or salt water) behind the casing. Commercial well logging techniques are available from Schlumberger, Halliburton and Western Atlas which provide thermal neutron decay time well logging by instruments having a $1^{11}/_{16}$ inch outer diameter so that they may pass through production tubing strings 232 of FIG. 7. Thus, by repetitively running such instruments into tubing string 232 from the surface, they may be run down into producing formation 26 and the level of the oil/water interface therein measured.

An upper packer 254 creates a seal between the outer surface of the production tubing section 250 and the bore 14 of the casing 12. The motor 252 is affixed at its lower end by means of a seal 256 to a second pump 258 which has intake ports 260 arranged about its circumference. An oil-water separator assembly 262 is affixed to the lower end of the second pump 258. Separated oil conduit 264 extends from the separator assembly 262 upward through the upper packer 254.

At the lower end of the separator assembly 262, a section of production tubing 266 interconnects the separator assembly 262 with a flow sensor fluid pressure sensor 268 which can measure injection pressure or pump intake pressure. Outflow tubing 270 extends downward from the lower end of the sensor 268 through a lower packer 272 toward the disposal zone 22. The lower packer 272 seals off the outflow tubing 270 against the bore 14. The outflow tubing 270 is provided with a close-off check valve 274 and a quick disconnect 276.

The production arrangement 230 described with respect to FIG. 7 operates generally as follows during a petroleum production operation. Production fluid from the oil layer 26 enters the wellbore casing 12 through the production perforations 34 and is drawn into the first pump 238 through lateral intake ports 240. The first pump 238 then pumps this relatively rich production fluid through the production tubing 232 toward the surface of the well 10.

Water from the water layer 28 of the production zone 16 also enters the wellbore casing 12 through the produced water perforations 36. The produced water is then drawn into the second pump 258 through its intake ports 260 and then pumped by the second pump 258 into the separator assembly 262. The produced water undergoes separation within the separator assembly 262 so that oil present within the produced water is separated from the water. Separated oil exits the separator assembly 262 via the separated oil conduit 264. The separated oil conduit 264 then transmits the separated oil through the upper packer 254 to dispose it into the bore 14 above the upper packer 254 where it mingles with the production fluid obtained from the oil layer 26.

During separation of the produced water from water layer 28, the separator assembly 262 also produces a separated water stream. The separated water stream is directed through tubing section 266, the monitor 268, and outflow tubing 270 toward the injection perforations 38 located below the lower packer 272. The separated water will then enter the zone 22 through the injection perforations 38.

By monitoring the amount of salt water saturation in the production fluid in the formation 16 and 26 as previously discussed, the approximate level of the oil-water contact 32 can be determined. If the amount of salt water saturation detected in the production fluid is too great, this may indicate that coning is occurring. If there is too little water detected in the production fluid, reverse coning may be occurring. The pump rates of the first and second pumps may then be adjusted from the surface to alter their relative flow rates and maintain the oil-water contact 32 at a desired position in which neither coning nor reverse coning occurs. The pumps 238, 258 are variable speed pumps whose rate of pumping may be increased or decreased when desired. Downhole pumps of this type are typically controlled from the surface, such as from a local surface-mounted computer. For example, if the coning is occurring, the flow rate of the first pump 238 may be reduced so that there is less oil being flowed to the surface. The production assembly 230 has the advantage over conventional assemblies that the pump rates can be modified during production. This principle can be applied to numerous other arrangements which feature two pumps which are positioned so that one is located above the oil-water contact and the other is located below the oil-water contact. The production assembly 120, for example, which was described with respect to FIG. 4, could be modified to incorporate a sensor at the approximate level of the oil-water contact 32. Means for controlling the speed or pump rates of the two pumps 134 and 150 would permit the amount of coning or reverse coning to be controlled.

It is contemplated that reservoir management using the type of system depicted in FIG. 7 can begin at the time that production from the well 10 is first begun. After the well 10 is drilled and cased, the approximate location of the oil-water contact 32 is determined using traditional wireline logging. The perforations 34, 36, 38 are then made through the casing 12 where appropriate based upon this information. The production assembly 230 is then assembled and tripped in so that the packer 254 is at the approximate level of the oil-water contact 32. The upper and lower packers 254, 272 are then set within the well 10. The first and second motors 244, 252 are then started to drive the first and second pumps 238 and 258.

It is noted that there is often sufficient natural pressure in the surrounding formation 16 so that it is not necessary to pump the production fluid to the surface of the well 10. It is also not typically necessary at such an early stage in a well's life to separate the oil and water in the production fluid as the production fluid obtained is relatively rich with oil. In that case, the sliding sleeve 234 may be moved to its open position 234A so that fluid communication may occur through the fluid ports 236. The motor 244 and first pump 238 remain unenergized. Unseparated production fluid entering the bore 14 through production perforations 34 enters the production tubing 232 through the fluid ports 236. The production fluid then travels upward through the production tubing 232 to the surface of the well 10.

At a later stage in the life of the well 10, formation pressure may decline to the point where it becomes desirable to assist the flow of production fluid to the surface of the well. This can be accomplished by moving the sliding sleeve 234 to its closed position 234B and energizing the motor 244 so that production fluid is drawn into the first pump 238 through intake ports 240. The pump 238 then pumps the production fluid upward through production tubing 232 for collection at the surface of the well 10.

Figure 8:
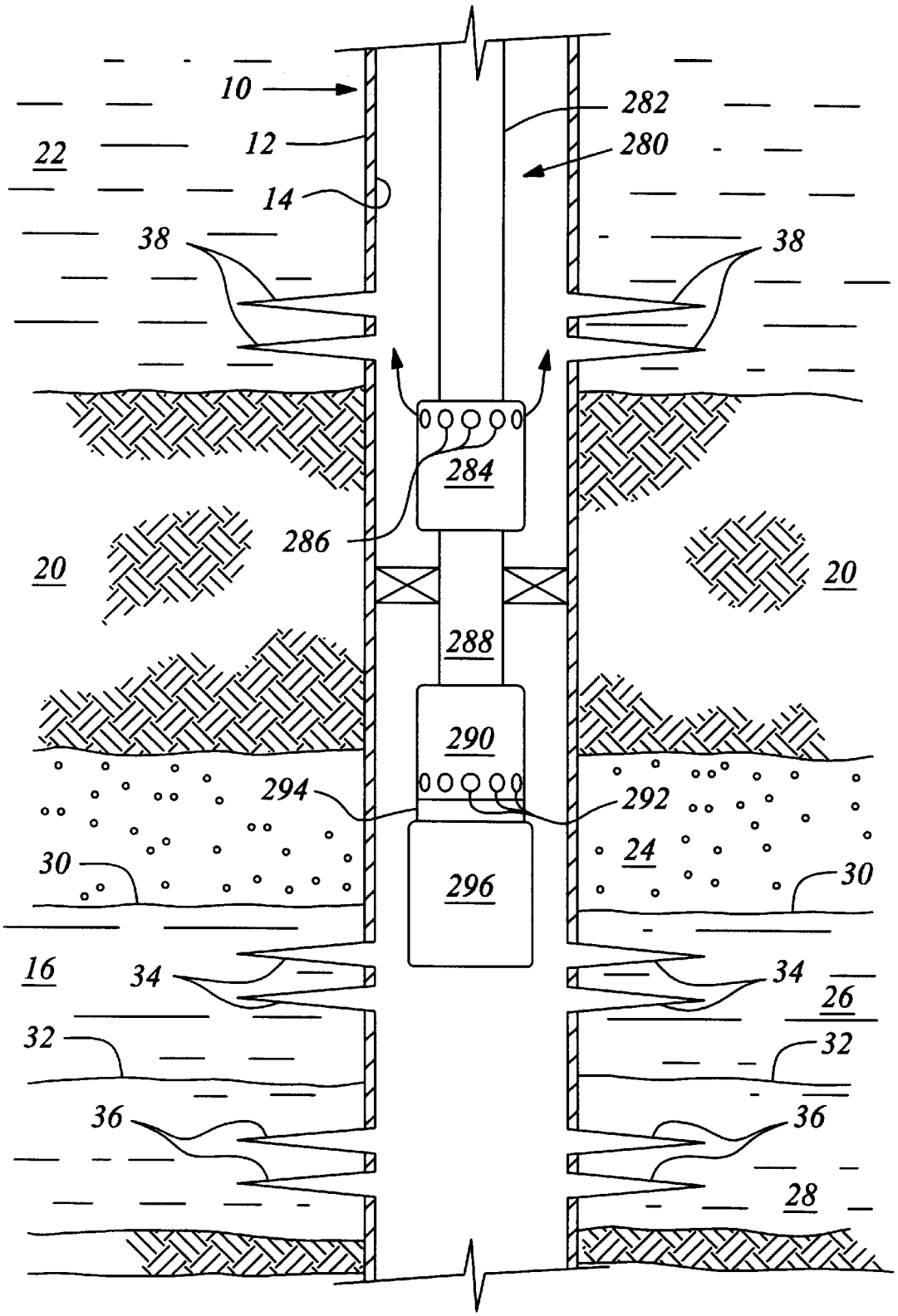
FIG. 8 is a cross-sectional schematic drawing of an exemplary production assembly which obtains intermingled production fluid and produced water and separates the oil and water components.

Referring now to FIG. 8, a production arrangement 280 is depicted in which the disposal zone 22 is located uphole from the production reservoir 16 and is separated from the production reservoir 16 by impenetrable zone 20. Within the production reservoir 16 are disposed production fluid perforations 34 through the casing 12 in between the gas-oil contact 30 and the oil-water contact 32 so that fluid from the oil layer 26 can enter the bore 14. Produced water perforations 36 are disposed through the casing 12 below the oil-water contact 32 so that fluid from the water layer 28 can enter the bore 14.

The production arrangement 280 includes production tubing 282 which is disposed within the bore 14. At the lower end of the production tubing 282 is affixed a separator assembly 284 having fluid outlets 286 disposed about its circumference. A production tubing section 288 extends from the lower end of the separator assembly 284 to a pump 290 having lateral fluid intake ports 292. The pump 290 is affixed by means of a seal 294 to a motor 296.

In operation, the production arrangement 280 of FIG. 8, permits production of concentrated oil from the production reservoir 16 while production water is moved from the production reservoir 16 to the disposal zone 22. However, this arrangement does not require the approximate location of the oil-water contact to be monitored or adjusted. There is no attempt made to maintain the oil-water contact 32 at any particular level, nor is there any attempt made to prevent or regulate coning or reverse coning. Operation of the motor 296 causes production fluid and production water to be drawn into the bore 14 through the production perforations 34 and produced water perforations 36 and then into the pump 290 through the intake ports 292. The combined production fluid and production water are then pumped by the pump 290 upward through the production tubing section 288 to the separator 284. The separator 284 then separates the fluids into their constituents of concentrated oil and separated water. The separated water is disposed through the outlet ports 286 of the separator so that it may enter the injection perforations 38. The concentrated oil is disposed upwardly through the production tubing 282 to the surface of the well 10 for collection.

Figure 9:
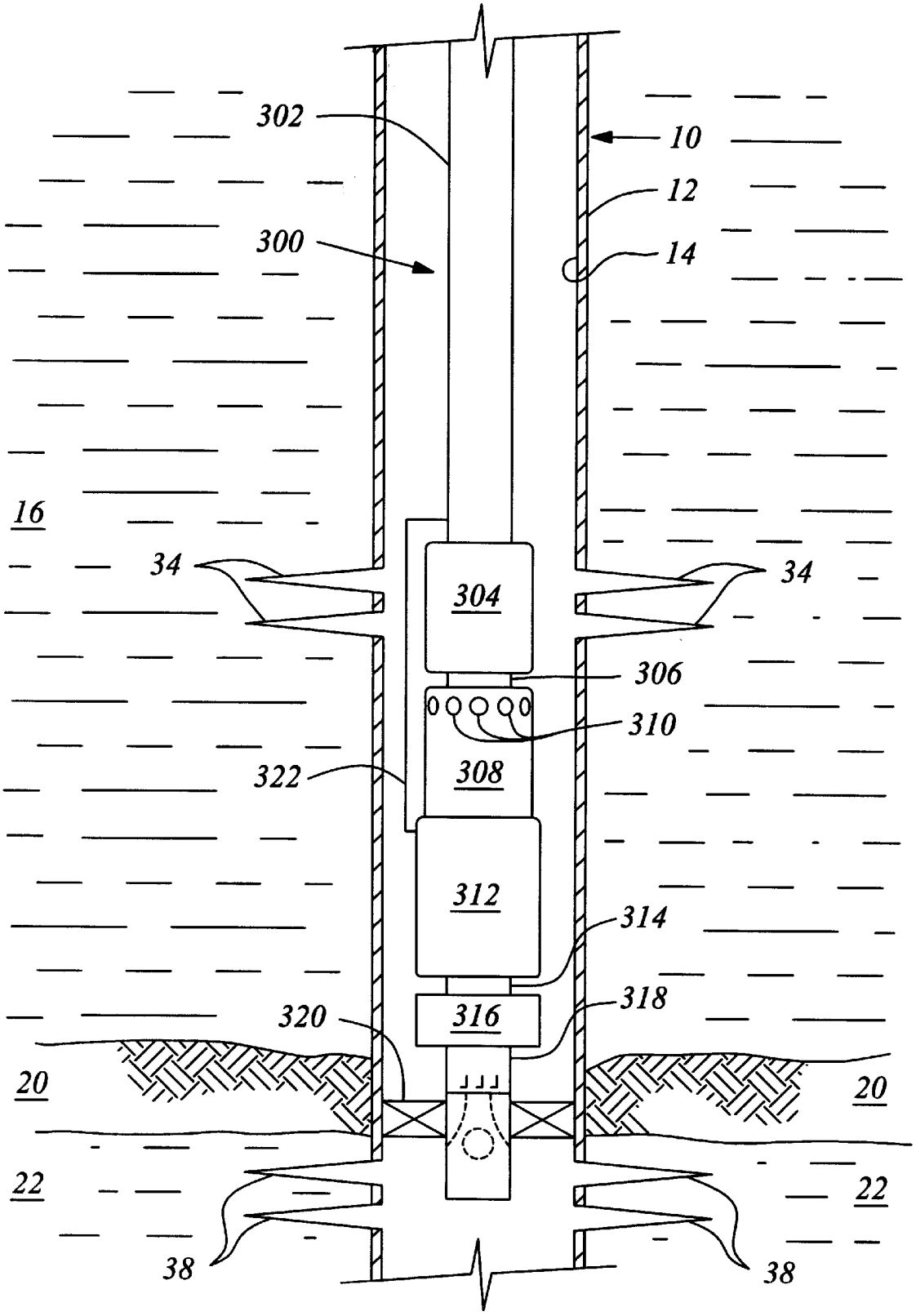
FIG. 9 is a cross-sectional schematic drawing of an exemplary production assembly which also obtains intermingled production fluid and produced water and separates the oil and water components.

Referring now to FIG. 9, a production arrangement 300 is depicted in which a flow control device is incorporated to control the underflow of a separator device. Production arrangement 300 includes production tubing 302 which is disposed within the bore 14. The lower end of the production tubing 302 is affixed to a motor 304 which, in turn, is affixed by means of seal 306 to pump 308. The pump 308 includes lateral fluid intake ports 310 and is affixed, at its lower end to a separator assembly 312.

A connector sub or production tubing section 314 interconnects the separator assembly 312 to a flow control device 316. The flow control device 316 regulates the flow of production fluid through the separator assembly 312. A suitable flow control device for this purpose is the Baker Surface Flow Regulator available from Baker Oil Tools of Houston, Tex. Beneath the flow control device 316, outflow tubing 318 extends through a packer 320. A concentrated oil conduit 322 extends between the separator 312 and the production tubing 302.

The production arrangement 300 of FIG. 9 operates as follows. Production fluid from reservoir 16 enters the bore 14 through production perforations 34 and is then drawn into the pump 308 through intake ports 310. The pump 308 pumps the production fluid through the separator assembly 312 where it is separated into its components of concentrated oil and separated water. The concentrated oil is directed through the concentrated oil conduit 322 and into the production tubing 302 for direction to the surface of the well 10. Separated water exits the separator assembly through the tubing section 314 and is transmitted through the flow control device 316 and outflow tubing 318 toward injection perforations 38. Use of the flow control device 316 is generally advantageous and, indeed, may be applied to other exemplary production arrangements described herein as well as modifications or alterations of described designs. The flow control afforded by device 316 helps to avoid an undesirable condition known as pump runout which has been known to occur during start-up conditions. Pump runout will cause the pump 308 to wear more rapidly and result in the separator not separating effectively.

Figure 10:
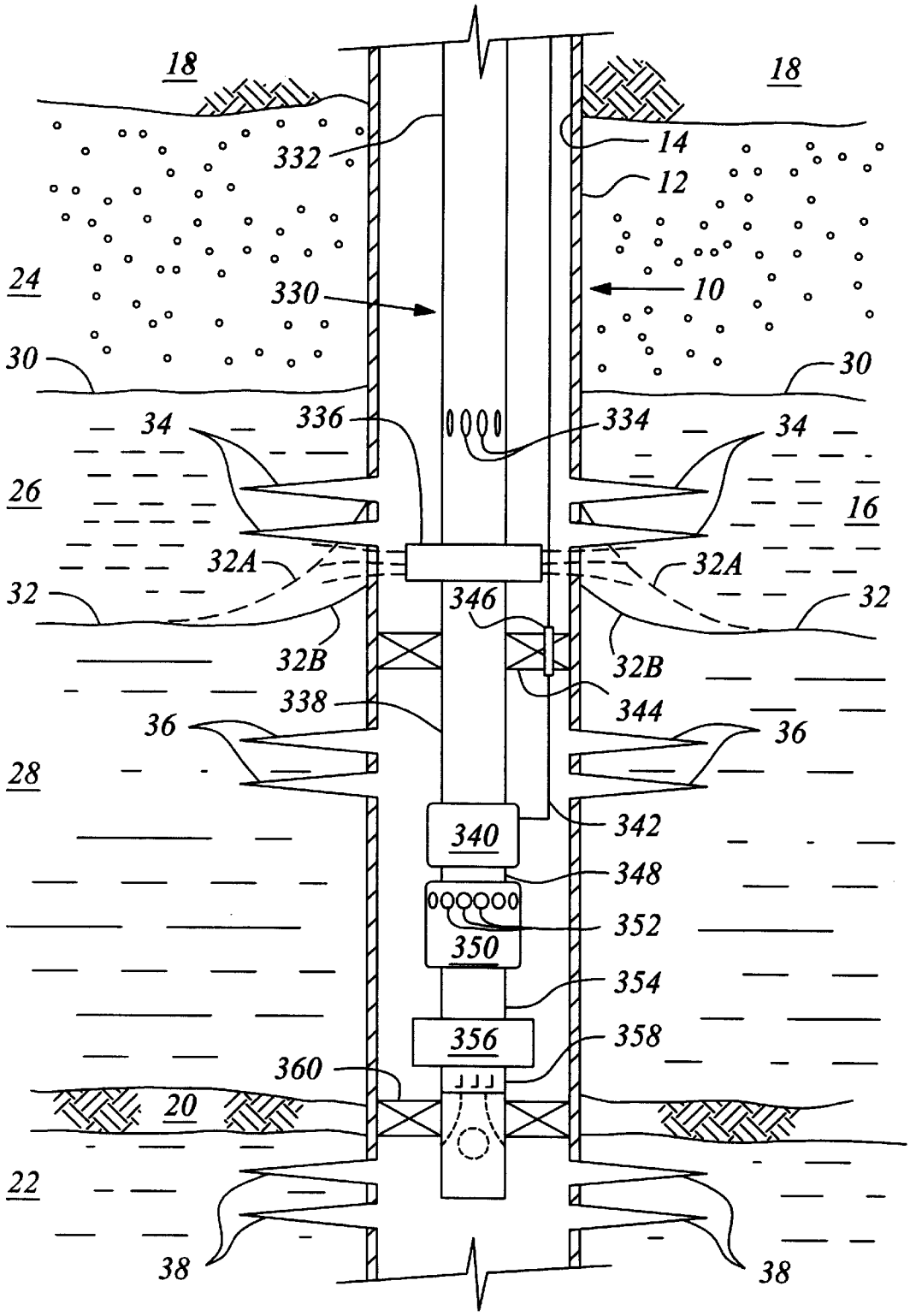
FIG. 10 is a cross-sectional schematic drawing of a further exemplary production assembly constructed in accordance with the present invention.

A further exemplary production assembly 330 is depicted in FIG. 10 wherein production tubing 332 is disposed in a suspended relation within the bore 14 of casing 12. The production tubing 332 includes a perforated section with fluid communication ports 334 disposed about the circumference of the tubing 332. At the lower end of the production tubing 332 is affixed a sensor 336 which corresponds to the sensor 248 described earlier. A production tubing section 338 interconnects the lower end of the sensor 336 with submersible motor 340. A power cable 342 extends downward from the surface (not shown) of the well 10 to provide power to the motor 340. A packer 344 establishes a seal between the production tubing section 338 and the bore 14. A packer penetrator 346, of the type described earlier, is used to pass the power cable 342 through the packer 344. The motor 340 is affixed by seal 348 to fluid pump 350 having lateral fluid intake ports 352. A tubing section 354 extends from the lower end of the pump 350 and is affixed, at its lower end, to a fluid flow monitor 356 which is similar to the monitor 268 described earlier. The monitor 356 is capable of measuring one or more fluid parameters such as flow rate, fluid pressure or the content of oil within the produced water. Outflow tubing 358 extends downward below the monitor 356. A lower packer 360 creates a seal between the tubing 358 and the bore 14. As with other embodiments, the outflow tubing 358 is equipped with a fluid check valve and quick disconnect.

Prior to operation, the production assembly 330 is disposed within the wellbore 14 so that the sensor 336 is positioned at or slightly below the level of the production perforations 34. In this manner, the production assembly 330 will be well positioned to detect and avert detrimental coning.

In operation, the production assembly 330 operates as follows. Production fluid enters the bore 14 through production perforations 34 and, thereupon, enters the production tubing through perforations 334 wherein it can be carried to the surface of the well 10. Although not shown in FIG. 10, the production fluid may, if needed or desired, be assisted toward the surface using any of a number of standard or known techniques including gas lift, a surface-based rod pumps, progressive cavity pumps and so forth. Meanwhile, produced water enters the wellbore 14 through produced water perforations 36. Operation of the motor 340 will cause the pump 350 to draw the produced water into the pump 350 through the intake ports 352 and transmit the produced water downward through the tubing 354, monitor 356 and outflow tubing 358 so that it may enter the injection perforations 38.

FIG. 10 also illustrates the suppression or reduction of a cone. A harmful degree of coning is illustrated by the dashed pronounced cone 32A in FIG. 10, as the cone 32A has reached the level of the production perforations 34. As the production fluid is removed in the described manner, the oil-water contact 32 may tend to drift upward to a position approximating the pronounced cone 32A. A reduced or suppressed cone is also depicted in FIG. 10 with solid lines at 32B. The pronounced cone 32A may be drawn downward to approximate the suppressed cone 32B by increased operation of the pump 350 to draw additional produced water into the pump 350 through intake ports 352 and toward the injection perforations 38.

It is pointed out that the invention has been described here in terms of preferred embodiments, which are merely exemplary. For example, it would be possible to use alternative devices for determining either the water content within the production zone or the approximate level of the oil-water contact. Also, the components and arrangement of the production assembly may be changed or rearranged. For instance, instead of using cables disposed within the well to provide power to and/or communicate with downhole components such as motors, pumps, sensors and monitors, self-contained power sources, such as batteries might be disposed within the wellbore to provide power and remote wireless communication devices, of a type known in the art, could be used to send signals to and receive information from the downhole components. Those skilled in the art will recognize that numerous such modifications and changes may be made while remaining within the scope and spirit of the invention.

What is claimed is:

1. A production string assembly for producing hydrocarbon fluid from a wellbore having a zone subject to coning during production, said assembly comprising;

production tubing extending down into the wellbore from the surface to a hydrocarbon rich production zone, a water rich production zone and disposal zone;

a first packer in the wellbore isolating a first pair of said zones from each other;

a second packer in the wellbore isolating a second pair of said zones from each other;

a first pump and motor arrangement receiving produced hydrocarbon rich fluid from the hydrocarbon rich zone and delivering the hydrocarbon rich fluid under pressure to the surface;

a second pump and motor arrangement together with a separator separated from the first arrangement by one of the packers and receiving produced fluid from the water rich production zone and separating it into a hydrocarbon rich stream and a water rich stream for disposal in the disposal zone;

a first fluid flow connection between the separator through said one of said packers for flow of the hydrocarbon rich stream from the separator to the first pump and motor arrangement; and a second fluid flow connection between the separator and the disposal zone through the other of said packers for delivery of the water rich stream of the second separator to the disposal zone, wherein at least one of the packers is positioned generally at the interface between the water rich zone and the hydrocarbon rich production zone and further comprising a sensor that monitors the level of the oil/water interface in the wellbore positioned adjacent said packer positioned generally at the interface.

2. The production string assembly of claim 1, further comprising a controller receiving signals from the sensor and controlling the operation of the second pump and motor arrangement and associated separator to control the level of the interface.

3. A downhole production string assembly having two modes of operation, comprising:

production tubing extending down from the surface to a hydrocarbon producing zone downhole, at least one inlet port in the tubing in fluid communication with the producing zone, a valve associated with the port for selectively opening the port to the inflow of produced fluid during a first mode of operation of the assembly and closing the port in the second mode of operation of the assembly;

a pump and motor arrangement selectively operable in a first mode in which the arrangement does not pump fluid to the separator and a second mode, in which the arrangement flows produced fluid through the separator, whereby in the first mode of operation of the production string assembly downhole, the port is open and produced fluid is free to flow to the surface under reservoir pressure, and in a second mode of operation of the production string remaining downhole, the port is closed and the pump and motor arrangement is in operation and the produced fluid is pumped under pressure for delivery to the surface.

4. The production string assembly of claim 3 further comprising a sliding sleeve valve constituting the port and valve.

5. The production string assembly of claim 3, further comprising a sensor positioned generally at an interface between the hydrocarbon producing zone and a water rich zone, wherein the sensor that monitors the level of the interface in the wellbore.

6. The production string assembly of claim 5, further comprising a second pump and motor arrangement wherein the second arrangement receives produced fluid from the water rich production zone and separates a water rich stream for disposal in the disposal zone.

7. The production string assembly of claim 3, further comprising a flow connection between the separator and a water disposal zone, a check valve in the flow connection and a selectively actuated release mechanism in the flow connection for enabling retrieval of the separator arrangement whereby with the separator retrieved uphole, the packer and the check valve remain downhole and block fluid communication between an adjacent producing zone and the water disposal zone.

8. A retrievable downhole hydrocarbon/water separator assembly, comprising;

a separator, pump and motor arrangement positioned downhole for separating produced fluid from a hydrocarbon production zone into a hydrocarbon rich stream for delivery to the surface and a water rich stream for disposal downhole in a water disposal zone;

a packer isolating the separator, pump and motor arrangement from the disposal zone;

a first fluid flow connection between the separator, pump and motor arrangement and the disposal zone through the packer for flow of the water rich stream to the disposal zone; and a check valve in the first fluid flow connection for blocking the return flow of fluid from the disposal zone and a selectively actuated release mechanism in the connection between the packer and the separator arrangement for enabling retrieval of the separator arrangement whereby with the separator retrieved uphole, the packer and the check valve remain downhole and block fluid communication between the hydrocarbon production zone and the water disposal zone.

9. A production string assembly for producing hydrocarbon fluid from a wellbore, comprising:

production tubing extending down into the wellbore from the surface to a hydrocarbon rich production zone, a water rich production zone and a disposal zone;

a first packer in the wellbore isolating a first pair of said zones from each other;

a second packer in the wellbore isolating a second pair of said zones from each other;

a first pump and motor arrangement receiving produced hydrocarbon rich fluid from the hydrocarbon rich zone and delivering the hydrocarbon rich fluid under pressure to the surface;

a second pump and motor arrangement separated from the first arrangement by one of the packers;

a solids separator fluidicly coupled to the second pump and motor arrangement, the solids separator receiving fluid from the water rich production zone and separating solids from the fluid;

a hydrocarbon/water separator fluidicly coupled to the solids separator, the hydrocarbon/water separator receiving the fluid from the solids separator and separating the fluid into a hydrocarbon rich stream and a water rich stream;

a first fluid flow connection fluidicly coupled between the hydrocarbon/water separator and the first pump and motor arrangement for flow of the hydrocarbon rich stream to the first pump and motor arrangement; and a second fluid flow connection fluidicly coupled between the hydrocarbon/water separator and the disposal zone for flow of the water rich stream to the disposal zone.

10. The production string assembly of claim 9, further comprising a flow connection between one of the separators and a water disposal zone, a check valve in the flow connection and a selectively actuated release mechanism in the flow connection for enabling retrieval of the separator arrangement whereby with the separator retrieved uphole, the packer and the check valve remain downhole and block fluid communication between an adjacent producing zone and the water disposal zone.

11. The production string assembly of claim 9, further comprising a third fluid flow connection fluidicly coupled between the solids separator and the first pump and motor arrangement for flow of separated solids to the first pump and motor arrangement.

* * * * *